United States Patent [19]

Plenk

[11] 4,262,925

[45] Apr. 21, 1981

[54] SKI WITH NON-SYMMETRICAL RUNNING SURFACE

[75] Inventor: Hans-Joachim Plenk, Ruhpolding, Fed. Rep. of Germany

[73] Assignee: Jochen Plenk KG, Fed. Rep. of Germany

[21] Appl. No.: 965,274

[22] Filed: Dec. 1, 1978

Related U.S. Application Data

[62] Division of Ser. No. 753,696, Dec. 23, 1976, Pat. No. 4,147,377.

[30] Foreign Application Priority Data

Dec. 29, 1975 [DE] Fed. Rep. of Germany ..... 2558939

[51] Int. Cl.[3] ..... A63C 5/04

[52] U.S. Cl. ..... 280/604; 280/609; 280/615; 280/636

[58] Field of Search ..... 280/609, 604, 607, 608, 280/601, 615, 614, 636, 619, 11.37 G

[56] References Cited

U.S. PATENT DOCUMENTS

| | | | |
|---|---|---|---|
| 3,178,194 | 4/1965 | Buchmuller | 280/604 |
| 3,304,095 | 2/1967 | Carlton | 280/609 |
| 3,514,119 | 5/1970 | Sutherland | 280/617 |
| 3,520,546 | 7/1970 | Joseph | 280/601 |
| 4,027,895 | 6/1977 | Larsson | 280/609 |
| 4,147,377 | 4/1979 | Plenk | 280/609 |

FOREIGN PATENT DOCUMENTS

| | | | |
|---|---|---|---|
| 1149653 | 5/1963 | Fed. Rep. of Germany | 280/604 |
| 2627887 | 12/1977 | Fed. Rep. of Germany | 280/609 |
| 944646 | 4/1949 | France | 280/609 |
| 2258875 | 8/1975 | France | 280/601 |
| 346603 | 2/1937 | Italy | 280/609 |

*Primary Examiner*—David M. Mitchell

*Attorney, Agent, or Firm*—Cesari and McKenna

[57] ABSTRACT

A ski, particularly a cross-country ski having improved sliding and adhering properties, which comprises a running surface subdivided into at least two zones, which can include an obtuse angle between them, and/or wedge-shaped parts on its top surface.

5 Claims, 4 Drawing Figures

SKI WITH NON-SYMMETRICAL RUNNING SURFACE

This is a division, of application Ser. No. 753,696 filed Dec. 23, 1976 now U.S. Pat. No. 4,147,377.

BACKGROUND OF THE INVENTION

1. Field to Which the Invention Relates

The invention relates to a ski, more particularly a cross-country ski.

2. The Prior Art

Skis, more particularly cross-country skis, have to meet antagonistic requirements as regards the sliding properties. On the one hand the ski should be able to slide as readily as possible so that on downhill runs the highest possible speed can be achieved. On the other hand the ski should be able to adhere sufficiently well that it does not slide backwards on ascending slopes and thus require excessive exertion on the part of the skier.

These mutually antagonistic requirements with respect to the properties of the running surface of a ski depend on the friction, which is produced in the case of specific environmental conditions, more particularly the snow conditions and temperatures and in the case of a certain pressure on the running surface.

Apart from the above mentioned parameters, the respective optimum sliding characteristic of a surface depends upon the cross-country technique. In the case of the travelling technique to be found more especially in the Scandinavian countries, the ski slides evenly, while in the case of other techniques the ski has to be caused to leave the ground with a pushing action. In the case of these different travelling techniques it follows as a matter of course that there are different requirements as regards the sliding and adhering properties of the ski on the snow so that the sliding properties have to be modified accordingly.

Various methods have been proposed for influencing the sliding properties in such a manner that the best possible running properties can be achieved. Thus for example, the running surface can be waxed, the wax being suitably selected in accordance with the snow which is actually lying on the ground. This method is, however, relatively elaborate and requires a certain degree of experience, since a large number of types of waxes are available.

Furthermore the surface of the cross-country ski is provided with scales or depressions and pieces or straps of leather or skin which are intended to create a running surface which ensures the utmost consistency as regards running properties despite different snow conditions and skiing techniques. In this respect no treatment of the running surface is therefore necessary. On the other hand a cross-country ski, which has been suitably waxed generally has better sliding properties than a scale ski or a leather ski, so that this construction of the running surface has up till now only being regarded as a compromise.

As regards the sliding and adhering or "grip" properties of a ski, very complex requirements therefore arise, since it is necessary to ensure both sufficient adherence on using the ski to push the body forwards, and a satisfactory sliding characteristic upon sliding.

These mutually antagonistic properties on the running surface can only be attained in the case of prior art skis with substantial difficulty.

On the other hand the sliding and adhering property of a ski also changes during a run. In the case of certain snow conditions the wax must be applied relatively thickly on the ski. During travelling this wax tends gradually to become uneven and form scales so that the running surface does not remain flat and smooth and the specific sliding properties of the ski are changed. Furthermore the wax can also ice up, that is to say snow and ice can stick to the wax if during a run different snow conditions are encountered as for instance will be the case when after passing over a run exposed to sunshine, whose snow is relatively moist, the skier travels through a wood in which the snow is substantially colder; furthermore the snow conditions can be caused to change simply owing to rise in temperature. Both the smearing of the wax to form scales and also icing up of the wax impair employment of cross-country runs and the chances of winning races or other competitions to a substantial extent.

Cross-country skiers have a tendency to change the sliding properties of skies by displacing their weight in a direction perpendicular to the longitudinal axis of the ski, something which is however only possible to a slight extent.

One aim of the invention is therefore that of creating a ski, more particularly a cross-country one, which has sliding and adhering properties which are substantially improved and can be matched to suit each other in a simpler manner and which make possible or facilitate displacement of the weight of the skier in a direction perpendicular to the longitudinal direction of the ski.

In order to achieve these and other aims the invention provides a ski in which the running surface is subdivided into two zones with different sliding properties and which run parallel to the longitudinal edge of the ski for at least a part of the length of the ski.

In the case of a ski, more particularly a cross-country ski, the above aim is also attained by the feature that on the topside of the ski adjacent to the position of the ski boot at least one wedge part is provided. The aim of the invention can also be attained in the case of a ski in accordance with the invention by providing the feature of a running surface consisting of two parts, which make an obtuse angle to each other.

The aim in accordance with the invention can also be achieved in the case of a ski by making it possible to change the position of the boot on the top side of the ski in a direction perpendicular to the longitudinal axis of the ski.

Advantageous forms of the measure in accordance with the invention are defined in the subordinate claims.

On climbing a skier tends to place his weight on the inside edge of the ski so that the latter can dig into the snow so as to guarantee an improved adherence or grip of the ski on the snow. On travelling downhill the skier will assume a crouching position and on doing so displaces his weight more towards the outer edges or respectively the outer part of the skis so that the latter slide more readily. This conventional technique can be substantially aided by the measure in accordance with the invention, since the two zones of the running surface can be so treated or constructed that they have the respectively optimum sliding properties. Thus the inner part of the ski, that is to say the part of the ski which is closer to the inner edge, can be waxed differently to the outer zone in such a manner that the inner zone has a less slippery, slower wax with more adherence or grip for climbing, while on the outer zone a faster and more slippery wax is provided for descents and for travelling on level ground. Accordingly it is possible to achieve a better compromise between the mutually antagonistic requirements as regards the sliding and grip or adherence properties of the ski. In the case of changing snow conditions, that is to say in the case of snow which has properties owing to different amounts of sunshine falling on it, the skier can alter the sliding properties of the ski to a certain extent as may be desired by simply displacing his weight to one side which has the better sliding or alternatively adhering or gripping properties for the snow which is actually under him and which is provided with a wax, which is best suited to the snow on the ground. Such a ski offers substantial advantages over known skies both as regards the climbing and downhill running properties of the ski and also as regards the different snow properties on all runs.

In accordance with a preferred embodiment of the invention the guide groove, running parallel to the longitudinal edge of the ski, and which is present in practically all skies, is displaced from the center of the ski so that it forms a boundary between zones with different specific sliding properties. In this manner these zones with different sliding properties are delimited or defined and if required are adapted to the specific requirements of a skier or, respectively, the various conditions occurring.

In most cases the inner zone of the ski will be broader than the outer zone, since the inner zone has more adherence or grip and should accordingly also exhibit more friction. It is however also conceivable that the outer zone can be made broader, if this should be advantageous for the particular style of running of a skier.

In order to make it easier for the skier to displace his weight or respectively to make possible a specially defined displacement of his weight, in the boot zone a wedge-shaped part is provided on the top surface of the ski in accordance with a preferred embodiment of the invention. The height of this part decreases from the inner edge to the outer edge. In this manner a different pressure will always be produced on the outer and inner zone of the ski respectively without the skier having intentionally to displace or shift his weight. The height of the wedge-shaped part and the position, at which the wedge-shaped part is provided, depends from the individual wishes and the style of skiing of the skier. It is, however, advantageous to arrange such a wedge-shaped part in the toe or ball of the boot, since a skier generally exerts a greater pressure when climbing on the inner zone than on the outer zone of the running surface. Furthermore, a skier leans more to the front on climbing so that in this case there is a higher pressure on the ball of the foot and, respectively, on the toes than on the heel part. These movements carried out partly subconsciously by a skier when he climbs up hill, can be made more effective or more pronounced by the above mentioned measures, since owing to the wedge-shaped part the skier automatically displaces his weight in the required manner.

Additionally to or independently from the above described wedge-shaped part, a further wedge-shaped part can be provided, which is located under the heel zone of the skier. The height of this part also decreases from the outer edge towards the inner edge. This is generally advantageous because in the case of downhill runs the skier generally places more weight on the outer zone than on the inner zone of the running surface and on the other hand tends to crouch more so that a greater pressure is exerted on the heels. This as well leads as a matter of course to the correct displacement of the weight or distribution of it being achieved without the skier having to think consciously about whether he has correctly undertaken the rearrangement of his weight or if such a displacement of his weight is in fact necessary.

In accordance with the invention a displacement of the weight of the skier can also be produced by making it possible to change the position of the boot on the upper surface of the ski in a direction perpendicular to the longitudinal direction of the ski. In this manner a larger force is exerted as may be desired on the outer ski part or on the inner ski part so that as a result the sliding and gripping properties respectively are changed. In conjunction with this measure it is also possible to employ previously described measures for creating different sliding properties. The change in position of the boot in a direction perpendicular to the longitudinal direction of the ski can advantageously be brought about by providing the top surface of the ski adjacent to the boot heel with a device with notches for accepting a projection arranged on the heel.

In accordance with a further feature of the invention, the two different zones of the running surface consist of parts of the running surface which are at an obtuse angle to each other and the parts of the running surfaces can have different breadths or make different angles to the transverse axis of the ski.

In conjunction with the above described measures the form and type of waxing of the different zones of the running surface can furthermore be used for improving or for optimum adaptation of the adherent and sliding properties of the ski. In addition to the use of different types of wax the different sliding property can be achieved in the two different zones of the running surface by having different numbers, sizes and/or depths of the scales and, respectively, steps in the case of scale or stepped skies in the two zones running parallel to the longitudinal edge of the ski. In this manner the size of the contact surfaces between the running surface and the snow and the contact angle can be varied so that considerably different coefficients of friction and therefore also different specific sliding properties are achieved. In the case of a ski with a leather or skin strip the number and the breadth of the leather strips running parallel to the longitudinal edge of the ski can be different in the two different zones so that also the friction in two different zones is different between the running surface and the snow and accordingly the specific sliding properties are also changed.

Furthermore the invention provides a ski of the specific type mentioned in the case of which at least one additional groove, filled with wax, is provided parallel to the guide groove and which extends at least over a part of the waxed running surface.

In the case of this ski the running surface is run over with a scraping knife after applying the wax and the wax remains in the additional wax grooves, while the ski surface itself only has a very thin wax coating. As a result during travel the wax cannot clump together to form scales which would impair the sliding properties of the running surface. On the other hand it is only the wax in the grooves which can ice up so that snow and ice can only become attached on a substantially smaller part of the running surface than is the case with prior art skies, when the snow conditions change considerably during a run. Finally the additional grooves always have wax available in them if the thin wax layer should be removed.

The measure in accordance with the invention of providing grooves parallel to the guide groove can be provided independently from or also in conjunction with the measure of dividing the running surface into two zones with different specific sliding properties. If these grooves are provided in the case of such skis, they should normally be provided on the inner zone of the ski, since for most skiers it is advantageous if the inner zone has more grip or adherence and has purer sliding properties than the outer zone. It is naturally also possible to provide the grooves in the outer zone of the ski. Furthermore, the number of grooves in the inner zone and, respectively, in the outer zone can be different.

LIST OF THE SEVERAL FIGURES OF THE DRAWINGS

The invention will now be described in what follows referring to embodiments with reference to the accompanying diagrammatic drawings.

Figure 1:
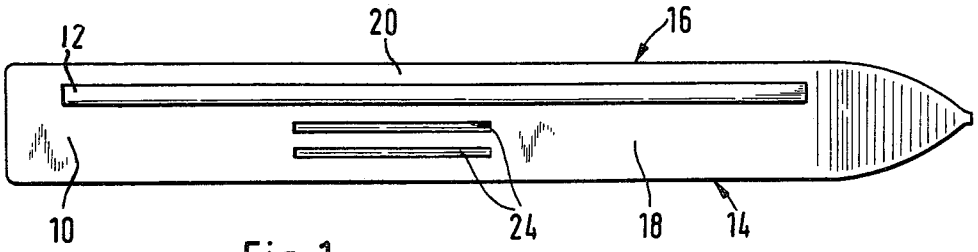
FIG. 1 shows the running surface of a ski with a few features in accordance with the invention.

The ski shown in FIG. 1 has a running surface 10, in which there is a guide groove 12, which is offset with respect to the center of the ski; accordingly the running surface 10 is divided up into two zones, of which the zone between the guide groove 12 and the inner edge 14 of the ski is broader than the zone between the guide groove 12 and the outer edge 16 of the ski. The word "inner edge" is in this respect intended to mean the edge of the ski, which is adjacent to the other ski.

The distance of the guide groove 12 from the center line of the ski and, respectively, from the inner edge 14 and the outer edge 16 depends upon the conditions obtaining and more particularly on the size of the area of the outer zone and the area of the inner zone.

Since generally the inner zone must have more grip or adherence than the outer zone, in the case of the embodiment shown in the drawing, the distance between the guide groove 12 and the inner edge 14 is larger than that between the outer edge 16 and the guiding groove 12.

The two zones so created and separated from each other by the guide groove 12, that is to say the broader inner zone 18 and the narrower outer zone 20 are so constructed or so treated that in the case of an equal pressure on the running surface, for example by the weight of the skier, and the same snow conditions, the friction per unit area between the inner zone 18 and the snow is larger than the friction between the outer zone 20 and the snow.

This therefore means that the two zones have a different specific sliding characteristic. Additionally for example the two zones can be differently waxed and in this case on the inner zone 18 a less smooth wax is applied, since when climbing uphill the skier will displace his weight to this zone of the running surface 10 so that the grip or adherence in this part should be particularly pronounced. On the outer zone 20 a wax is applied which improves the sliding properties, since more particularly in the case of travelling over level ground and on running downhill this zone has the weight of the body displaced on to it.

Figure 4:
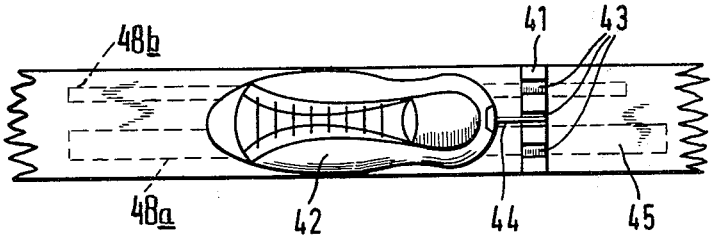
FIG. 4 shows a plan view of a part of the ski, on which the boot of the skier is located.

It will naturally be understood that the different specific sliding properties cannot only be achieved by using wax but also by using a suitable construction of the running surface in the case of wax-free skies, that is to say by the use of scales, steps and leather strips. For example in the case of a scaled or stepped ski, the number and height of the depressions of the scales or steps in the two zones of the running surface can be differently dimensioned or constructed as shown in dotted lines at **46*a* and 46*b* in FIG. 2 so that in this manner zones with different specific sliding properties are produced. In the case of leather strips more or broader hide or leather strips can be provided on one side of groove 12 than on the other side as shown in dotted lines at 48*a* and 48*b*** in FIG. 4. The shape, surface area and breadth of the scales or steps or strips of leather or hide can be selected by a person skilled in the art in accordance with the specific conditions obtaining.

Figure 2:
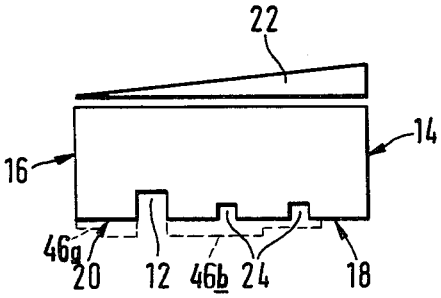
FIG. 2 shows a cross-section through the ski represented in FIG. 1.
Figure 3:
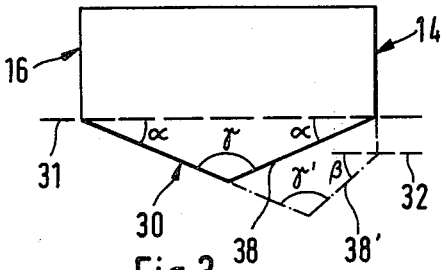
FIG. 3 shows a cross-section through a further ski, in accordance with the invention, adapted for attaining the aim of the invention.

FIG. 2 shows a cross-section through the ski represented in FIG. 1, which again makes clear the position of the guide groove 12 with reference to the edges of the ski. On the top side of the ski adjacent to the boot a wedge-shaped part 22 is arranged, for example by gluing, whose height decreases from the inner edge 14 towards the outer edge 16. This wedge-shaped part 22 is under the ball of the foot of the skier so that the latter as he bends further forward in the case of uphill travel naturally exerts a greater pressure on the inner zone 18 of the running surface 10. The dimensions of this wedge-shaped part 22 also depend upon the personal requirements and physiological or orthopaedic characteristics of the skier, his particular style and/or on the snow and terrain conditions.

A wedge-shaped part, whose height decreases from the outer edge towards the inner edge, is provided in the heel part of the boot.

Although the two measures proposed here do not necessarily have to be provided in the case of one and the same ski, two additional grooves 24 are provided parallel to the guide groove 12, which are filled with wax and are located in the binding zone of the ski. They can extend over a part of the length of the ski or over its whole length and the respective position, number and lengths of the additional groove 24 can be selected in accordance with the snow conditions and the style and weight of the skier. The depth of the additional grooves 24 depends inter alia on how much wax the grooves are to accommodate, that is to say how much wax is worn away, this depending on the hardness of the wax, on the run and on the snow conditions.

The additional grooves 24 are located on the broader inner zone 18 of the running surface 10 and if required it is possible to provide additional grooves on the other side of the guide groove 12 as well, if this should be convenient in the case of particular applications.

It is also to be mentioned that skies, more particularly cross-country skies, are centrally stressed so that in the case of pure sliding the central part, that is to say the binding zone of the ski does not engage the snow or only slightly engages it on sliding. If however the skier firmly pushes against the ground, he will force this center zone so as to deform it against the central stress and the ski will come to engage the snow in this zone. In the case of such a ski the additional grooves 24, filled with wax, should be provided at least in that part of the

[illegible] pressing on the center part of the skier, that [illegible] satisfactory adherence or grip, that is to [illegible] relatively high friction is attained, so that the ski cannot simply be pushed away to the rear.

The breadth of the grooves 24 and accordingly the ratio of groove surface to remaining running area should be so selected that a [illegible] the snow can adhere [illegible] the smallest [illegible] possible.

It is also possible to provide notches, grooves, holes or the like under the boot 42, into which pro[illegible] arranged on the underside of the boot [illegible].

While the invention has been [illegible] preferred embodiment [illegible] apparent to [illegible] ficati[illegible]